United States Patent [19]

Ohdai et al.

[11] 4,296,621

[45] Oct. 27, 1981

[54] MACHINES FOR FORMING COILED SPRINGS

[75] Inventors: Yozo Ohdai; Yasuyuki Takahata, both of Kasugai, Japan

[73] Assignee: Asahi-Seiki Manufacturing Co., Ltd., Owariasahi, Japan

[21] Appl. No.: 100,246

[22] Filed: Dec. 4, 1979

[30] Foreign Application Priority Data

Feb. 28, 1979 [JP] Japan ..... 54/23921

[51] Int. Cl.[3] ..... B21F 35/02; B21F 11/00; B21F 3/027

[52] U.S. Cl. ..... 72/130; 72/132; 72/137; 140/103

[58] Field of Search ..... 72/130, 131, 132, 135, 72/137, 140, 145; 140/103

[56] References Cited

U.S. PATENT DOCUMENTS

| | | | |
|---|---|---|---|
| 2,134,469 | 10/1938 | Bergevin | 72/137 X |
| 3,025,889 | 3/1962 | Clay | 72/137 X |
| 4,147,048 | 4/1979 | Herckelbout | 72/137 |
| 4,227,392 | 10/1980 | Itaya | 72/137 |
| 4,236,397 | 12/1980 | Lange | 72/137 |

FOREIGN PATENT DOCUMENTS

| | | | |
|---|---|---|---|
| 1335473 | 7/1963 | France | 140/103 |
| 381187 | 10/1964 | Switzerland | 72/137 |

*Primary Examiner*—Ervin M. Combs
*Attorney, Agent, or Firm*—Thomas R. Morrison

[57] ABSTRACT

A wire coil spring forming machine adapted for use with thick wire prevents breakage of a thin wall in a longitudinal groove in a wire guide member or quill when forming a sharp angle bent between a coil body portion and a leading end loop portion, and permits the start of the next spring leading end loop during formation of last spring trailing end loop. A pair of radially movable members move to advanced positions where they grasp the wire portion of an already formed leading end loop just in front of the longitudinal groove. Another radially movable member abuts the loop to bend it at that point without applying the bending force to the longitudinal groove. A body holder means grasps the body after the main tool forms the trailing end loop to permit severing the semifinished spring from the material wire and bending the trailing end loop.

9 Claims, 24 Drawing Figures

MACHINES FOR FORMING COILED SPRINGS

BACKGROUND OF THE INVENTION

The present invention relates generally to machines for successively forming helical coil springs each consisting for successively forming tension, compression or torsion helical coil springs consisting of a body portion having a number of loops and opposite end loops for attachment. More particularly, the present invention relates to machines in which a wire guide member having a longitudinal groove or quill through which a length of wire is forcibly fed from a supply reel thereof employs a tool member having a tapered free end adapted to be radially movable timingly between a retracted position and an advanced position where the tapered end engages the wire emerging from the quill for bending and coiling to form the leading end loop portion, then the coiled body portion and finally the trailing end loop portion.

Various machines of the type as referred to above have been proposed. For example, U.S. Pat. No. 3,025,889 discloses a machine in which a quill is provided with a coil receiving void at one side thereof so as to be substantially in the form of a longitudinally cut half cylinder. As well known by those skilled in the art, a void is necessary for permitting the formed coil body portion to locate there while the end loop portion is being formed. Since the metal wall thickness between the void surface and the longitudinally extending groove or quill formed in the solid guide member must be fairly thin, the wall is easily broken at the wire output end of the quill when bending wire of a large diameter through a large angle such as 90°.

Machines according to the prior art can practically produce coiled springs from wire having a diameter generally up to the order of about 1 mm. It is often necessary, however, to make springs from wire having a diameter on the order of from a few to several mm. Hitherto, the end loops of such coil spring have had to be formed by a separate tool or machine in order to avoid breaking the thin wall of the quill. Thus, either the straight wire portion connected to the coil body or the outermost of the coils of the coil body formed by conventional coiling machines inclusive of the machine referred to above, requires subsequent mandrel-die bending operations to complete the spring.

OBJECTS AND SUMMARY OF THE INVENTION

It is an object of the present invention to avoid breaking of the guide member thin wall between the longitudinal wire guide groove and the adjacent void side surface which has been encountered in conventional machines.

A further object of the invention is to provide machines for successively forming helical coil springs each having end loops from large diameter wire.

A still further object is to provide machines as capable of starting a new coil spring during formation of the trailing end loop portion of the preceding coil spring.

These and other objects may be attained according to the invention by providing second tool means comprising a pair of opposite holder members each adapted to be radially movable between the respective retracted and advanced positions so that the free ends thereof may firmly hold the wire just in front of the longitudinal wire guide groove in the machines. advanced positions, third tool means comprising a member adapted to be movable radially between the retracted and advanced positions but in eccentrically deviated manner so that the free end of the advanced third member may abut the leading end loop wire portion where the wire is held by the pair of holder members and further advancing thereof may form a large angle bend between the leading end loop portion already formed and the outermost loop of the body portion to be formed, first body portion holder means so located in relation to the guide member as to receive the body portion when the trailing end loop portion is being formed by the first tool member and hold the body portion at the leading half thereof for facilitating severing of the coil spring at the tail of the trailing end loop portion from the material wire, second body portion holder means so located in relation to the first holder means as to receive the body portion at the trailing half thereof and hold the spring portion together therewith, and means for forming a large angle bend between the trailing end loop portion and the concerned outermost loop of the body portion in cooperation with the body portion holder means.

The above, and other objects, features and advantages of the present invention, will become apparent from the following description read in conjunction with the accompanying drawings in which like reference numerals designate the same elements.

DETAILED DESCRIPTION OF THE PREFERRED EMBODIMENT

Figure 1:
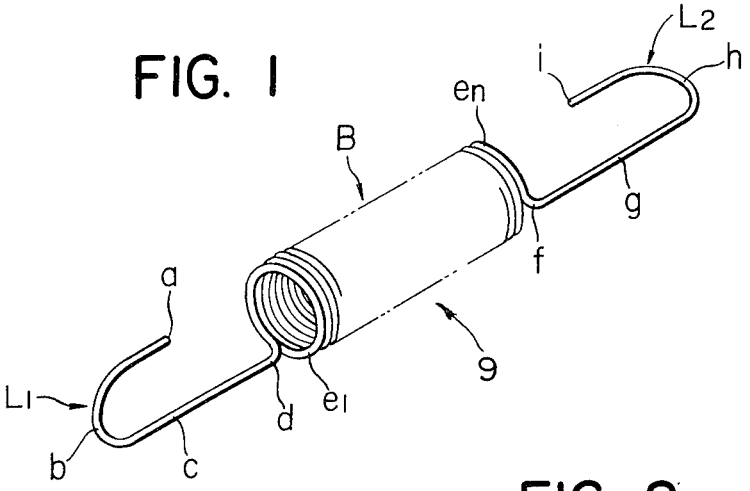
FIG. 1 is a perspective view of one type of coil springs formed by a machine according to the invention.

Referring now to FIG. 1, a coil spring 9 manufactured by a machine according to the present invention is illustrated by way of example. Coil spring 9 comprises a body portion B and opposite end loop portions $L_1$, $L_2$ for attachment. The leading end loop portion $L_1$ has a free end a, a loop b, a straight leg c and a root d. The body portion B consists of a desired number of loops $e_1 \ldots e_n$. The body portion B is connected to the leading end portion $L_1$ at the root d at an angle of about 90° in such a way that the plane formed by the leading end loop portion $L_1$ is disposed substantially perpendicular to the plane of said loops $e_1 \ldots e_n$ to pass through the axis of the cylindrical body portion B. The trailing end loop portion $L_2$ similarly has a root f, a straight leg g, a loop h and a free end i. The plane formed by the trailing end loop $L_2$ is also disposed perpendicular to the plane of the loops but at a 90° angular difference relative to the plane of the leading end loop portion $L_1$.

Of course, many other varieties of coiled springs may be manufactured according to the present invention. For instance, the loops may be open to act in compression rather than in tension. The leading and/or trailing end loop portions may not have a straight leg and may have other shapes depending on the manner of attachment and the use thereof. The plane of the end loop portions may be in other angular relations to each other and to the body portion. The end loop portions may not always start from the outermost loop of the body but may consist of a diametrically extending cross bar portion between the end loop portion and the outermost loop, sometimes called the British type.

Figure 2:
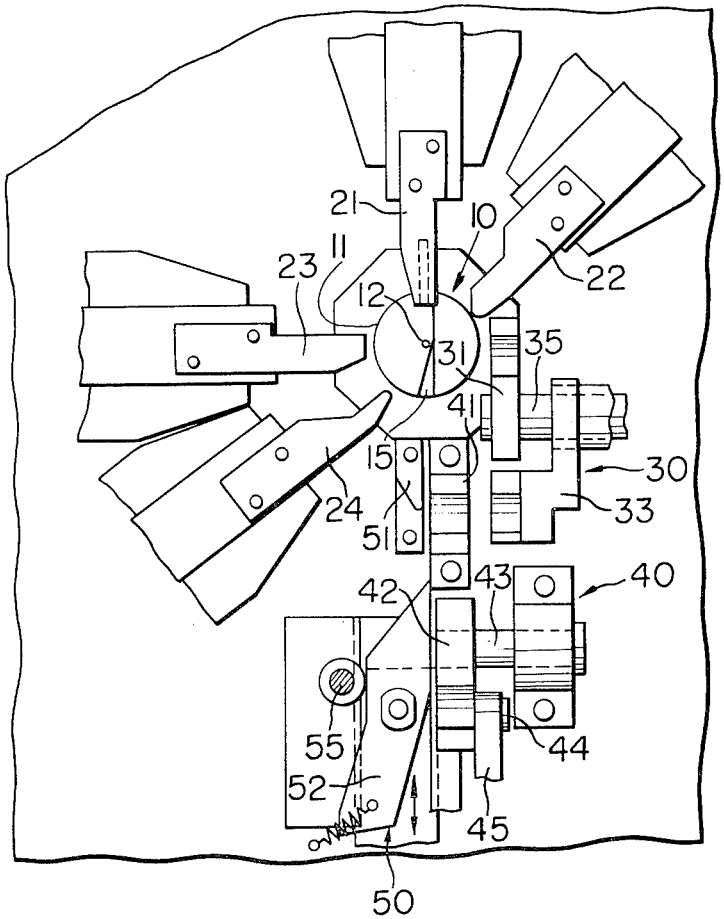
FIG. 2 is a partial front view schematically showing a face plate of a machine according to the present invention on which are mounted a guide member, and a plurality of radially movable tools for bending, coiling and holding shown in their respective retracted or inoperative positions.
Figure 3:
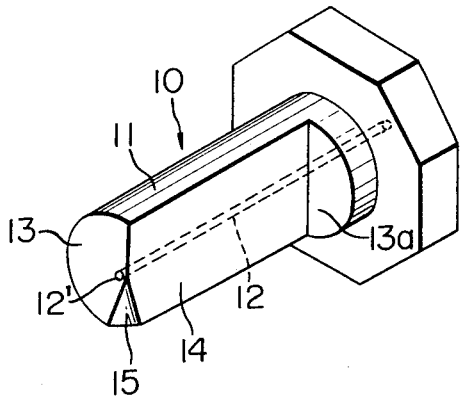
FIG. 3 is a perspective view of a longitudinal wire guide member in the machine of FIG. 2.

Referring now to FIG. 2, there is shown a front frame plate of a coil spring forming machine according to the present invention on which a wire guide member or quill represented generally by 10 is fixedly mounted. Referring also to FIG. 3, the quill 10 comprises a forwardly protruding head 11 in the form of a longitudinally cut cylindrical half having a longitudinal wire guide groove 12 for forcibly passing a length of wire W therethrough. Longitudinal wire guide groove 12 emerges from the quill 10 at a half circular front end surface 13 of the head 11. The cylindrical half head 11 has a substantially flat side surface 14 to form a void for receiving the semifinished coil spring there during bending of the end loop portion, as is well known to those skilled in the art and will be appreciated by studying the detailed explanation to be made hereafter. In view of the half cylindrical configuration of the head 11, a complementary half circular surface 13*a* is formed at the root thereof, as best shown in FIG. 3. The head 11 has a bevelled surface 15 formed by cutting the edge formed by the front end surface 13 and the side surface 14 below the wire output orifice 12'. Bevelled surface 15 is effective to permit deflection of the wire W as it is forcibly fed out of quill 10.

Means for forcibly feeding the wire W through the groove 12, for instance a pair of drums (not shown) may be mounted at the rear of said frame plate. Since means for feeding wire are well known to those skilled in the art and are outside the scope of the present invention, illustration and description thereof are omitted.

Figure 5:
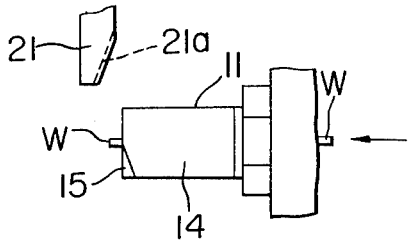
FIG. 5 is a schematic side elevation viewed from the right hand in FIG. 4 showing the longitudinal wire guide member and the first tool in its retracted position.
Figure 6:
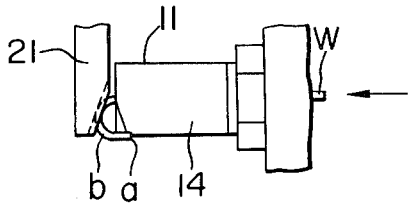
FIG. 6 is a schematic side elevation similar to FIG. 5 in which the first tool is advanced into its operative position for forming the leading end of the loop portion of a coil spring.
Figure 4:
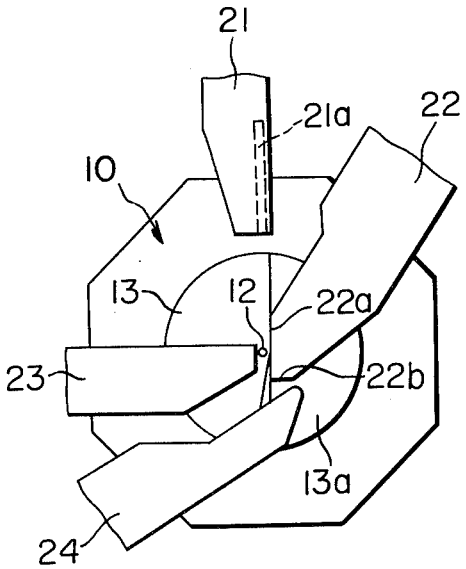
FIG. 4 is a schematic front view in a larger scale of the longitudinal wire guide member of FIG. 2 including a first tool for bending and coiling shown in its retracted position, and second main and complementary tools and a third tool for bending shown in their advanced or operative positions.

Referring to FIGS. 2 and 4, four tools 21, 22, 23 and 24 are disposed around the quill 10 so as to be respectively radially movable relative to the longitudinal wire guide groove 12. The first tool 21 has a longitudinal groove 21*a* which can be positioned to engage the wire for bending the same by movement between the retracted position in FIG. 4 and the advanced, or operative, position shown for instance in FIGS. 6 and 8 where the free end thereof is positioned a little below the wire orifice 12'. It will be appreciated by reference to the side elevation of FIGS. 5 and 6 that when lowering the first tool 21 from the retracted position as shown in FIG. 5 to the advanced position as shown in FIG. 6, the bevelled and grooved end of the tool 21 engages a free end of the wire W now being forcibly extruded from the orifice 12' and thus bends it downwards so that the end of the wire W abuts and is deflected by the bevelled surface 15 of the quill 10.

The second main and complementary tools 22, 23 are opposedly arranged to be respectively radially movable between the retracted, or inoperative, positions in FIG. 2 and the advanced, or operative, positions in FIG. 4. In the operative positions, a vertically straight end portion 22*a* of the second main tool 22 and a vertically straight end of the complementary tool 23 firmly grasp the wire W therebetween. Tools 22, 23 serve as the wire holding means and the former may also play a role of a cutter for severing the wire W as will be explained in more detail later.

Figure 10:
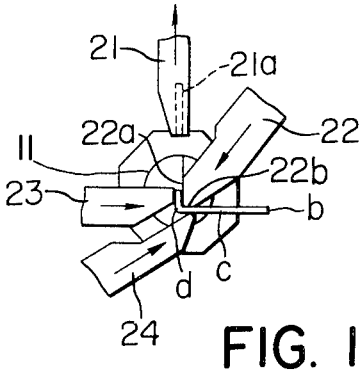
FIG. 10 is a view similar to FIG. 8 showing the first tool in its retracted position, the pair of second tools and the third tool in their respective advanced positions for holding the wire and bending the leading end loop portion at the root thereof transversely relative to the wire feeding direction about 90°.

The third tool 24 is adapted also to be radially movable between its retracted, or inoperative, position in FIG. 2 and the advanced, or operative, position in FIG. 4 so as to bend the wire with aid of a transversely straight end portion 22*b* of the second main tool 22, as best shown in FIG. 10. A conventional mechanism for timingly moving tools 21, 22, 23 and 24 is mounted at the rear side of said frame plate, but is not explained in detail since it has no direct relation with the present invention.

FIG. 2 shows further a first holding means represented generally by 30 for grasping the semifinished formed coil spring at the leading half thereof, a second holding means represented generally by 40 for grasping the semifinished formed coil spring at the trailing half thereof, and a fourth tool means generally represented by 50.

Before beginning the explanation of the above, the operation of forming the leading end loop portion $L_1$ and the loops of the body portion B are explained with reference to FIGS. 5 through 14 for the purpose of understanding the procedure.

When the leading end of the wire W is forcibly fed through wire output orifice 12', the first tool 21 is timingly lowered from the retracted position in FIG. 5 to the advanced position in FIG. 6.

Figure 7:
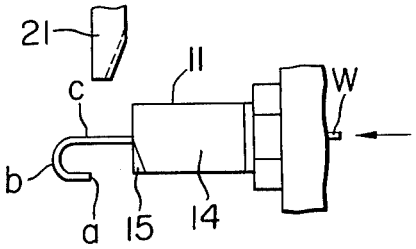
FIG. 7 is a view similar to FIG. 5 with the first tool in its retracted position and the formed wire of the end loop being moved outward by advance of the wire.

The end of wire W engages the slanted longitudinal groove 21*a* and is thereby deflected downwards to form a leading end loop b which abuts the beveled surface 15 to be deviated thereby. The tool 21 is then retracted as shown in FIG. 7. The continuously extruded wire W forms the straight leg c.

Figure 8:
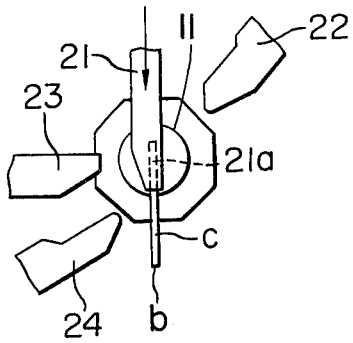
FIG. 8 is an enlarged view similar to FIG. 4 showing the first tool in its operative position for bending the leading end loop portion at the root thereof downwards about 90°.
Figure 9:
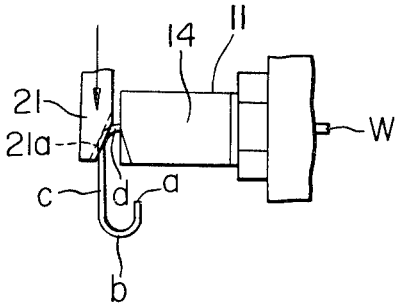
FIG. 9 is a side view of FIG. 8.

When the necessary length of the leg c has been extruded, the tool 21 is lowered again as shown in FIGS. 8 and 9 so as to bend the wire W about 90° downwards relative to the quill 10 to form the root d of the end loop portion $L_1$. Immediately after the formation of said 90° bend, the first tool 21 is retracted again and the second main and supplemental tools 22 and 23 are advanced to firmly grasp the wire W between the vertically straight end of the latter and the vertically straight end portion 22*a* of the former. The third tool 24 is advanced to bend the end loop portion $L_1$ at the root d transversely relative to the quill 10 so that the plane of the end loop portion $L_1$ is disposed perpendicular to the plane of the spring loops to be formed. It should be noted that the radial movement of the third tool 24 is deviated in a different manner than the first tool 21 and second tools 22, 23 so that the free end of the third tool 24 is engaged in an overlapping manner with the transversely straight end portion 22*b* of the second main tool 22 as illustrated in FIG. 10. Thus, despite the sharp bending of the thick wire W by a large angle, say 90° in the direction which would otherwise break the thin metal wall formed between the longitudinal wire guide groove 12 and the flat side surface 14 of the head 11, the grasping of the wire W by the second tools 22 and 23 protects the quill 10 from being broken by force applied to the wire W.

Figure 13:
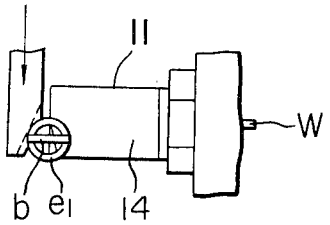
FIG. 13 is a view similar to FIG. 9 showing the operative status similar to that of FIG. 12.
Figure 14:
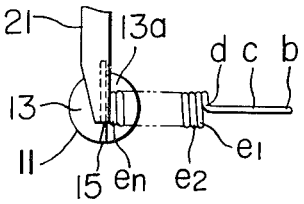
FIG. 14 is a view similar to FIG. 12 showing the operative status when a desired number of loops having been coiled.
Figure 11:
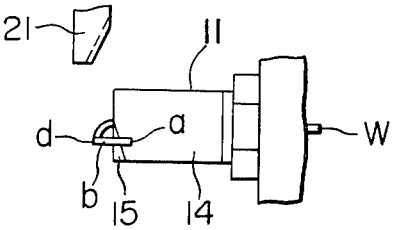
FIG. 11 is a side view at the conclusion of the operation of FIG. 10.
Figure 12:
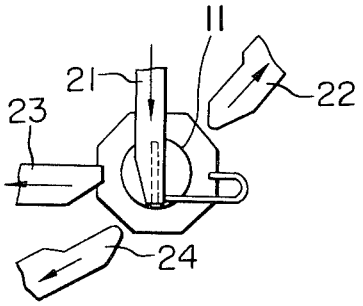
FIG. 12 is a view similar to FIG. 10 showing the first tool in its advanced position ready to start forming helical loops of the coil spring.

The second tools 22, 23 and the third tool 24 are retracted and the first tool 21 is again advanced as shown in FIGS. 12 and 13 for starting to form the spring loops $e_1$ - - - $e_n$ of the spring body portion B. By keeping the first tool 21 in the operative position shown for a predetermined time in relation to the wire feed speed, a necessary number of spring loop $e_n$ are formed as shown in FIG. 14.

Figure 15:
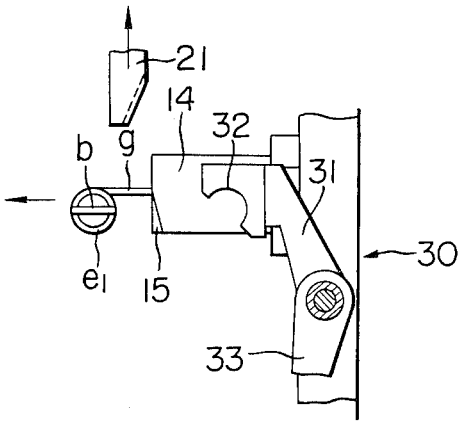
FIG. 15 is a side view showing first holding means for holding the coil body portion in its retracted or inoperative position.

When the tool 21 is retracted as shown in FIG. 15, the continuously fed wire W forms the straight leg g of the trailing end loop portion $L_2$. At this stage the bend or root f of said trailing end loop portion $L_2$ has not yet been formed. The upper body holder means or first holding means represented generally by 30 comprises an upper arm 31 having a free end 32 adapted to fittingly receive the leading half of the body portion B of the spring and a lower arm 33 having a free end 34 (FIG. 16) adapted to fittingly receive the leading half of the body portion cooperatively with the free end 32 of the upper arm 31.

Figure 16:
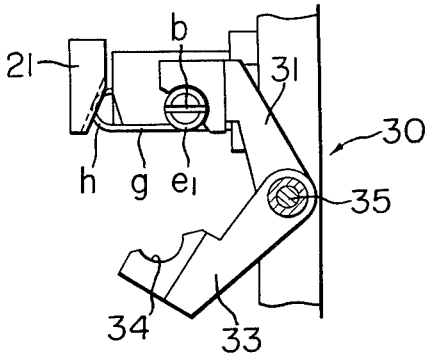
FIG. 16 is a view similar to FIG. 15 in which the first tool is in its operative position for forming the trailing end loop and for bringing the coil body portion to the position where a leading half of the body loops may be grasped by the first holding means.

As seen in said FIG. 16, when the first tool 21 is lowered for forming the loop h of the trailing end loop $L_2$ the body portion B is adapted to be received by a half circle recess in the free end 32. The apparatus is so designed that concurrently with the retraction of the first tool 21, the lower arm 33 is angularly moved on a pivot 35 mounted on the machine frame so as to firmly grip the body portion B as shown in FIG. 17.

Figure 18:
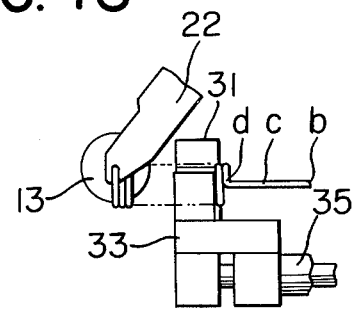
FIG. 18 is a view similar to FIG. 14 showing the first holding means in its operative position as in FIG. 17 and showing one of the second main tool in its further advanced position in which it severs the now finished coil spring at the end of the trailing end loop.

While the first holding means 30 grips the spring body B at the leading half thereof, as shown in FIG. 18, the second main tool 22 is advanced beyond the advanced position in which it holds the wire W in cooperation with the second complementary tool 23 as referred to above so as to cut the wire W at the free end h of the trailing end tool $L_2$.

Figure 17:
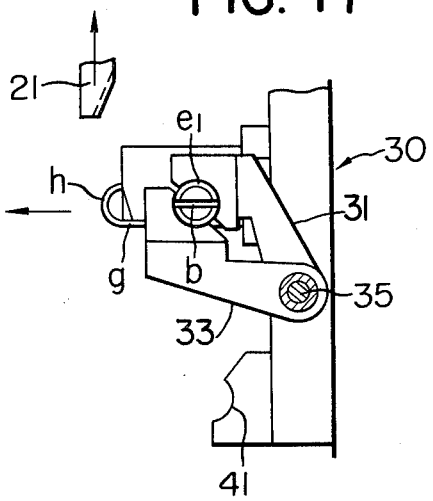
FIG. 17 is a view showing the first holding means grasping the body of the spring.
Figure 19:
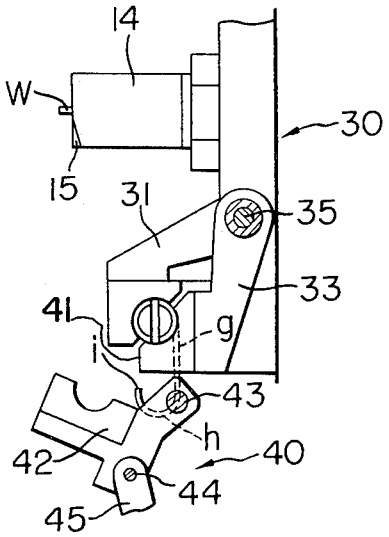
FIG. 19 is a view similar to FIG. 17 additionally showing a second means for holding the coil body portion, in which the first holding means is in its lower level holding position while the second holding means in its inactive position.

In reference to FIGS. 17 and 19, the second holder means 40 for holding the spring body portion comprises a half circular recess member 41 fixedly mounted on the machine frame and a movable half circular recess member 42 which is pivoted at a pivot 43 on the machine frame so as to be angularly moved by means of a driving rod 44 pivoted at a pivot 45 on said movable half circular recess member 42.

Figure 20:
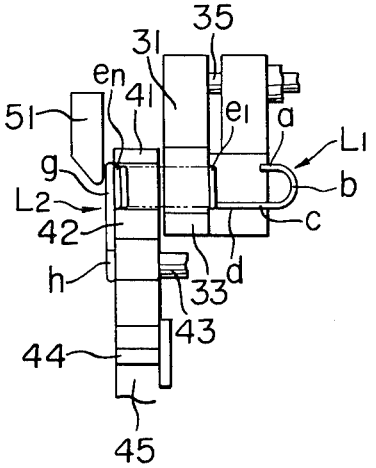
FIG. 20 is a schematic front view of the first and second coil body holding means respectively in the positions illustrated in FIG. 19 but omitting the guide member located thereabove for the sake of clarification.
Figure 21:
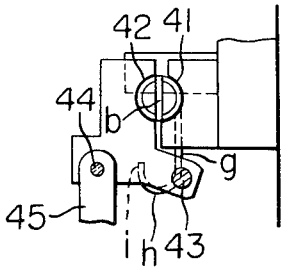
FIG. 21 is a view similar to FIG. 19 showing said second holding means in its operative position to grasp the trailing half of the coils.

After severing the trailing end loop portion $L_2$ at the free end i, as seen in FIG. 19 and FIG. 20, the first holding means 30 grasping the spring body portion B around the leading half thereof is angularly moved in to a lower level position where the trailing half thereof may rest on the half circular recess of the half circular recess member 41 which itself is best shown in FIG. 17. The movable half circular recess member 42 is then angularly moved to the position illustrated in FIGS. 21 and 22 where the leading half of the body portion B (the right half in FIG. 22) is held by the pair of first holding means 30 while the trailing half thereof (the left half in the drawing) is held by the second holding means 4 so that the leading end loop portion $L_1$ formed by a, b, c and d extends in axial direction of the coil spring (to the right in FIG. 22) while the trailing end loop portion $L_2$ formed by g, h and i extends in the coil spring radial direction (downwards in said FIG. 22).

Figure 22:
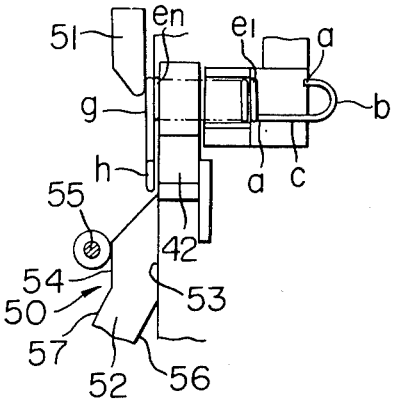
FIG. 22 is a view similar to FIG. 20 additionally showing another tool for bending the trailing end loop at the root thereof.
Figure 23:
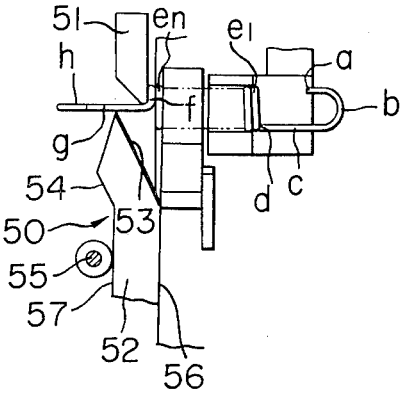
FIG. 23 is a view similar to FIG. 22 showing the trailing end loop portion bent about 90° at the root thereof.
Figure 24:
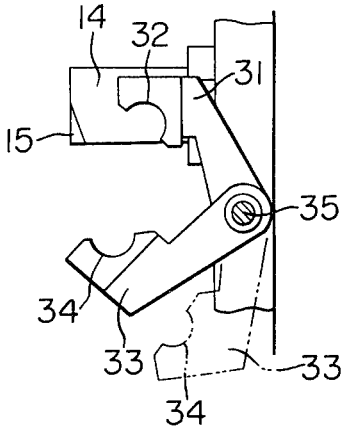
FIG. 24 is a view similar to FIGS. 15 and 16 showing the first holding means after having released the finishedly formed coil spring.

While the spring body B is being firmly held in the above manner, the trailing end loop portion $L_2$ is to be bent about 90° at root f as illustrated in FIGS. 22 and 23.

The fourth tool means represented generally by 50 comprises a fixed auxiliary tool 51 having a tipped free end directed downwards and arranged adjacent to the downwardly extended trailing end loop portion $L_2$ at the root f to be bent. A movable main tool 52 is disposed below the fixed auxiliary tool 51. The movable main tool 52 includes a tipped free end directed upwards, a back surface 53 and a front surface 54. The movable main tool 52 may be pushed upwards from the retracted position shown in FIG. 22 guided by abutment of the back surface 53 on a guide wall of the fixed frame plate and of the front surface 54 on a roller 55 mounted on the fixed frame plate. The tipped free end of the movable main tool 52 is rotated by roller 55 such that it is inserted between the loop h of the trailing end loop portion $L_2$ and the movable half circular recess member 42.

The movable main tool 52 has a second back surface 56 and a second front surface 57 respectively slanting to the back and front surface 53, 54 by an angle so that when the movable main tool 52 is further raised, it is guided by the abutment of the second back surface 56 on the guide wall and of the second front surface 57 on the guide roller 55 whereby the tipped end of the movable main tool 52 is moved in the direction for bending the trailing end loop portion $L_2$ at the root f in cooperation with the fixed auxiliary tool 51, as best shown in FIG. 23.

It will be appreciated that when the trailing end has been cut as shown in FIG. 19, the next spring forming operation may be started concurrently with the formation of the trailing end loop portion of the last spring.

Having described specific preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A machine for forming coil springs of the type having a coiled body portion and first and second end loops at opposed ends of said body portion comprising:

a wire guide member having a void in one side thereof for receiving a coiled body portion and a wire guide groove therethrough, said wire guide groove permitting a wire to be fed therethrough;

a first tool member having a tapered free end, said first tool members being mounted for movement from a retracted position to an advanced position in which said tapered free end is effective to contact said wire fed through said guide groove for bending and coiling thereof at a first position adjacent an outlet orifice of said guide groove;

a second tool member;

a complementary tool member;

said second and complementary tool members being mounted for movement into gripping abutment with said wire at said first position;

a third tool member for contacting and bending said wire through a large angle while it is gripped at said first position by said second and complementary tool members at a first end of said body adjacent said first position where said wire is gripped;

first holding means operative to grip said body at a first portion thereof;

second holding means operative to grip said body at a second portion thereof; and bending means for forming a large angle bend at a second end of said body adjacent a second position where said body is gripped by one of said first and second holding means.

2. A machine according to claim 1, wherein said second tool member and said complementary tool member include vertical sides effective to firmly grasp said wire at said first position and said second tool member further includes an inclined side for permitting access to said wire by said third tool member for bending said wire through a large angle.

3. A machine according to claim 1, wherein said second tool member includes means for severing said wire.

4. A machine according to claim 1, wherein said first holding means includes a first pivotable arm member having a semicircular recess therein, a second pivotable arm member having a second semicircular recess therein, and said first and second semicircular recesses being effective to abut and grip opposed sides of said body.

5. A machine according to claim 4, wherein said first and second pivotable arm members are jointly angularly movable to move said body to said second holding means.

6. A machine according to claim 1, wherein said second holding means includes a fixed member having a first semicircular recess therein and a pivotable member having a second semicircular recess therein, said pivotable member being movable into a position grippingly opposing said first and second semicircular recesses on opposite sides of said body.

7. A machine according to claim 6, wherein said first semicircular recess is operative to receive said body at said second portion therein while said body is gripped by said first holding means at said first portion.

8. A machine according to claim 1, wherein said bending means includes a fixed member having a first pointed free end and a movable member having a second pointed free end, said first and second pointed free ends cooperating to form said large angle bend.

9. A machine according to claim 8, wherein said movable member includes an elongated bar effective to advance said second pointed free end first toward said first pointed free end alongside said wire and then suddenly change its direction so as to bend said wire in said large angle bend over said first pointed free end.

* * * * *